US010697650B2

(12) United States Patent
Smith et al.

(10) Patent No.: US 10,697,650 B2
(45) Date of Patent: Jun. 30, 2020

(54) AUTOMATIC BALANCE VALVE CONTROL

(71) Applicant: Computime, Ltd., Wanchai (HK)

(72) Inventors: Philip John Smith, Guangdong (CN); Wai-Leung Ha, Hong Kong (CN); Dean Richard Jepson, Cluj-Napoca (RO); Chung-Ming Cheng, Hong Kong (CN); Kwok Wa Kenny Kam, Hong Kong (CN); Hao-Hui Huang, Guangdong (CN); Dick Kwai Chan, Hong Kong (CN); Hong Bin Liao, Shenzhen (CN)

(73) Assignee: Computime Ltd., New Territories (HK)

( * ) Notice: Subject to any disclaimer, the term of this patent is extended or adjusted under 35 U.S.C. 154(b) by 464 days.

(21) Appl. No.: 15/481,923

(22) Filed: Apr. 7, 2017

(65) Prior Publication Data

US 2018/0031251 A1 Feb. 1, 2018

Related U.S. Application Data

(60) Provisional application No. 62/367,268, filed on Jul. 27, 2016.

(51) Int. Cl.
*F24D 19/10* (2006.01)
*F24D 3/02* (2006.01)

(52) U.S. Cl.
CPC ..... *F24D 19/1018* (2013.01); *F24D 3/02* (2013.01); *F24D 2220/0257* (2013.01); *F24D 2220/0264* (2013.01)

(58) Field of Classification Search
CPC ..... F24D 19/1018; F24D 2220/0264; G05B 2219/2614

(Continued)

(56) References Cited

U.S. PATENT DOCUMENTS 4,969,598 A * 11/1990 Garris ..... G05D 23/1393 137/3
5,904,292 A * 5/1999 McIntosh ..... G05D 23/1393 165/295

(Continued)

FOREIGN PATENT DOCUMENTS

BR 102013110821 A1 4/2015
DE 102008061239 A1 6/2010

(Continued)

OTHER PUBLICATIONS

Stumpp, EP3034955 A1 English machine translation, Jun. 22, 2016 (Year: 2016).*

(Continued)

*Primary Examiner* — Edelmira Bosques
*Assistant Examiner* — Phillip Decker
(74) *Attorney, Agent, or Firm* — Banner & Witcoff, Ltd.

(57) ABSTRACT

A self-adjusting balance valve controller controls water flow through a hydronic emitter in a heating and/or cooling temperature control system. The valve controller obtains a measured temperature differential between an inlet and an outlet of the hydronic emitter and determines a displacement of a coupling pin from the measured temperature differential. The valve controller then instructs a driving mechanism to move, through a coupling mechanism, the coupling pin to adjust a valve that results in a desired water flow through the hydronic emitter. The valve controller may maintain a stable temperature differential at a desired differential value, which may be obtained through a user interface or from a memory device. Moreover, the desired differential value may vary with different times of operation or temperature control situations.

19 Claims, 6 Drawing Sheets

(58) Field of Classification Search
USPC ..... 237/8 A
See application file for complete search history.

(56) References Cited

U.S. PATENT DOCUMENTS 6,766,709 B1 * 7/2004 West ..... F16D 41/063 192/48.92
7,182,314 B2 * 2/2007 Harvey ..... F16K 1/221 251/129.11
8,708,244 B2 * 4/2014 Larsen ..... G05D 23/1919 237/69
9,267,694 B2 * 2/2016 Lang ..... G05D 23/08
9,822,904 B2 * 11/2017 Thybo ..... F16K 31/04
2007/0018007 A1 1/2007 Neill
2007/0295013 A1 * 12/2007 Bauer ..... F24D 19/1015 62/79
2010/0045470 A1 * 2/2010 Araiza ..... F24D 1/00 340/603
2010/0258194 A1 * 10/2010 Kim ..... F24D 19/1015 137/1
2010/0270385 A1 * 10/2010 Kim ..... F24D 19/1015 237/81
2012/0152367 A1 * 6/2012 Nielsen ..... F16K 37/0041 137/2
2012/0285441 A1 * 11/2012 Staroselsky ..... F24D 19/1057 126/615
2013/0081799 A1 * 4/2013 Loblich ..... G05D 23/1934 165/200
2013/0240172 A1 * 9/2013 Reilly ..... G05D 23/1931 165/11.1
2015/0102120 A1 * 4/2015 Sorensen ..... F24D 19/1018 237/8 A
2015/0316935 A1 * 11/2015 Schmidlin ..... F24D 19/1015 700/282
2015/0369494 A1 * 12/2015 Skovmose Kallesoe ..... F24D 19/1006 165/247
2016/0161142 A1 * 6/2016 Isaacson ..... F24D 19/1012 165/247
2016/0178220 A1 * 6/2016 Benson ..... C09K 5/20 237/8 A
2018/0058705 A1 * 3/2018 Ha ..... F24D 19/0056
2018/0347841 A1 * 12/2018 Wallace ..... F28F 27/00
2019/0331349 A1 * 10/2019 Smith ..... F24D 19/1018

FOREIGN PATENT DOCUMENTS

DE 102012011336 A1 9/2013
EP 2653789 A2 10/2013
EP 1754005 B1 * 11/2014 ..... F24D 19/1015
EP 3034955 A1 6/2016
GB 2452043 B 10/2009
GB 2461857 A * 1/2010 ..... F24D 19/0012
WO 2005098318 A1 10/2005
WO WO-2005119129 A1 * 12/2005 ..... F24D 19/1015
WO 2009072758 A1 6/2009
WO 2014094991 A1 6/2014

OTHER PUBLICATIONS

Feb. 1, 2018—(AU) Office Action—App 2017202924.
Nov. 16, 2017—(WO) Extended European Search Report—App EP 17178748.
Dec. 11, 2019—(EPO) Examination Report—Appln No. 17178748.4.

* cited by examiner

AUTOMATIC BALANCE VALVE CONTROL

This patent application claims priority to U.S. provisional patent application Ser. No. 62/367,268 entitled "Automatic Balance Valve Control" filed on Jul. 27, 2016, which is hereby incorporated by reference in its entirety.

TECHNICAL FIELD

Aspects of the disclosure relate to a self-adjusting balance valve controller for controlling water flow through a hydronic emitter (e.g., radiator) in an environmental temperature control system.

BACKGROUND OF THE INVENTION

For hydronic emitters (including radiators, underfloor heating/cooling circuits, fan coils, chilled beams) the rate at which the water flows through the emitters need to be regulated to ensure all circuits/emitters in an environmentally temperature controlled system are balanced. The water flow varies due to different distances, connection circuitry and size of the pipes from the water pressure source or water pump. In order to make the system work in balance, a mechanical or fixed flow restricting valve may be employed in the inlet and/or outlet of each hydronic emitter to allow it to regulate the flow rate of each emitter in order to maintain a balanced flow of the water to each emitter throughout the system.

This process of balancing an environmental temperature control system is often quite tedious and may require numerous iterations in order to fine tune a balanced system. The time required to balance a system may be extremely long with a more complicated configuration.

SUMMARY OF THE INVENTION

An aspect provides an automatic self-adjusting balance valve controller comprising a microprocessor with memory and two analog-to-digital inputs measuring the temperature of emitter inlet and outlet temperatures, The valve controller may include a motorized mechanism that can move a shaft to adjust the water flow valve pin length, where the measured temperature differential is used to adjust the shaft length to maintain a stable temperature difference between the inlet and outlet to the valve.

With another aspect, the temperature sensors may be separate radio frequency module sensors that report the measured temperatures to the balance valve periodically or by a wired communication.

With another aspect, the temperature differential setting between inlet and outlet to the balance valve may be a fixed value or a value that is provided through a user interface of the balance valve controller.

With another aspect, the temperature differential setting between inlet and outlet may be setup through any form of radio frequency signal to the balance valve controller before or during the operation of the balance valve controller or by a wired communication.

With another aspect, the balance valve controller may be powered by a main AC or low voltage AC/DC power supply or fully powered by battery or rechargeable battery. When supplied by AC or DC power supply, the power supply may be disconnected by an external thermostat. When power is disconnected from the balance valve, an internal energy storage circuitry enables the balance valve controller to continue to sustain the motor action to close the balance valve. The internal energy storage circuitry may be a battery, rechargeable battery, high capacity capacitor, and/or any form of energy storage module.

With another aspect, a variable differential value may be input to the balance valve to allow a different balance value at different times or temperature control situations, for example, when the emitter is required to provide more heating/cooling or less heating/cooling. This can be input via the user or by time schedule or by radio frequency or wired communication and so on.

BRIEF DESCRIPTION OF THE DRAWINGS

The foregoing summary of the invention, as well as the following detailed description of exemplary embodiments of the invention, is better understood when read in conjunction with the accompanying drawings, which are included by way of example, and not by way of limitation with regard to the claimed invention.

DETAILED DESCRIPTION

Figure 1:
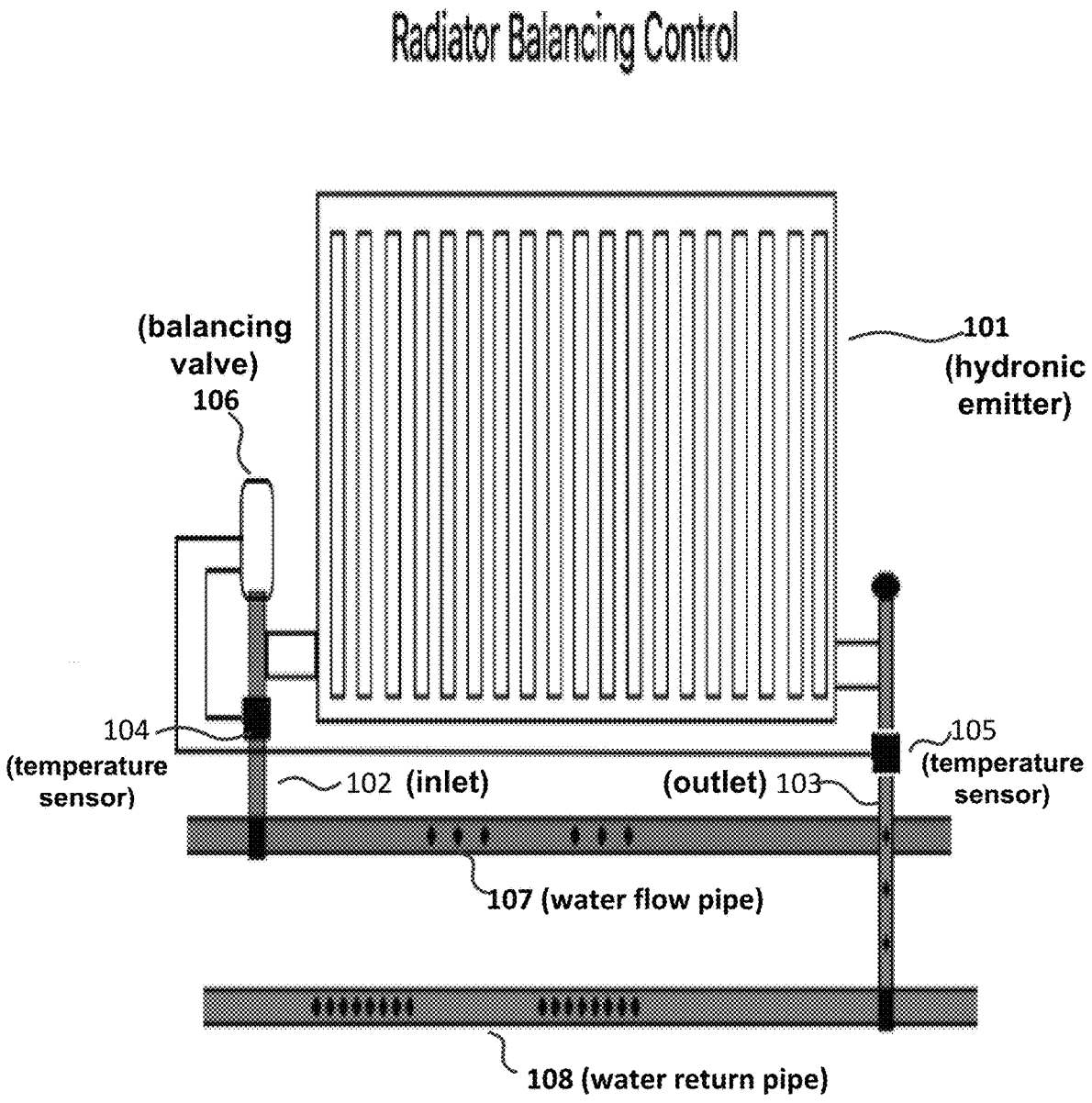
FIG. 1 shows a balance valve that controls heated/cooled water flow for a radiator in accordance with an embodiment.

FIG. 1 shows balance valve 106 that controls heated/cooled water flow for radiator (hydronic emitter) 101 in accordance with an embodiment. As will be discussed, balance valve 106 self-adjusts the water flow through radiator 101 to achieve a desired temperature differential between inlet 102 and outlet 103.

Balance valve 106 may support heating and/or cooling environmental systems. When supporting a heating mode, water flow pipe 107 transports heated water to radiator 101 through inlet 102. When supporting a cooling mode, water flow 107 transports cooled water. Water return pipe 108 returns the expended water from radiator 101 through outlet 103.

Balance valve 106 measures the inlet and outlet temperatures through temperature sensors 104 and 105, respectively, and adjusts the water flow through radiator 101 so that the measured temperature differential stabilizes to the desired temperature differential. For example, when balance valve 106 is operating in the heating mode and the measured outlet temperature is too high, balance valve 106 reduces the water flow though radiator 101 so that the radiator extracts more heat from the water flow. The balance valve 106 may be considered as being balanced when balance valve 106 has stabilized the temperature differential at a desired value.

Balance valve 106 may connect to temperature sensors 104 and 105 in a number of ways. For example, temperature sensors 104 and 105 may be separate radio frequency module sensors that report the measured temperatures to the balance valve periodically or by a wired communication.

Figure 2:
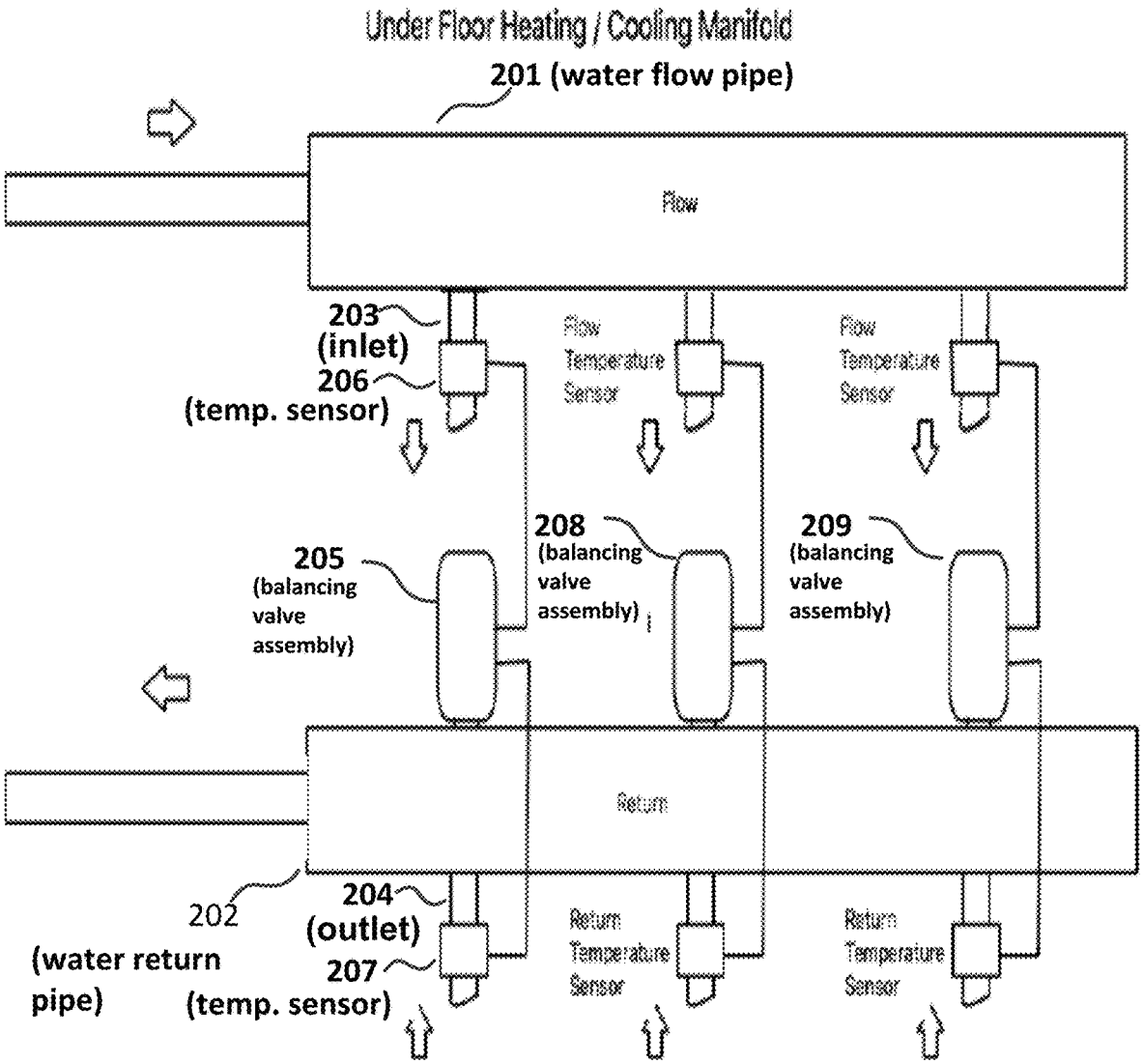
FIG. 2 shows an under-floor heating/cooling manifold in accordance with an embodiment.

FIG. 2 shows an under floor heating/cooling manifold of a temperature controlled system in accordance with an embodiment. With an aspect, the temperature controlled system uses electronically controlled motorized valves 205, 208, and 209 in lieu of fixed or mechanical balancing valves. Electronically controlled motorized valves 205, 208, and 209 may perform self-calibration to achieve the optimal operating level of balance (where the measured temperature differential is stabilized at a desired temperature differential) for each corresponding hydronic emitter. The balancing of the water flow of the environmental temperature control system is achieved by balancing each circuit individually. (With some operating scenarios, each valve may be differently configured to compensate for variations of desired operation, water flow, water temperature, and emitter characteristics.)

Referring to balancing valve 205, controlled water flow to the corresponding hydronic emitter (not explicitly shown) is through inlet 203 (from water flow pipe 201) and outlet 204 (to return pipe 202). The measured temperature differential is provided by temperature sensors 206 and 207.

Figure 3A:
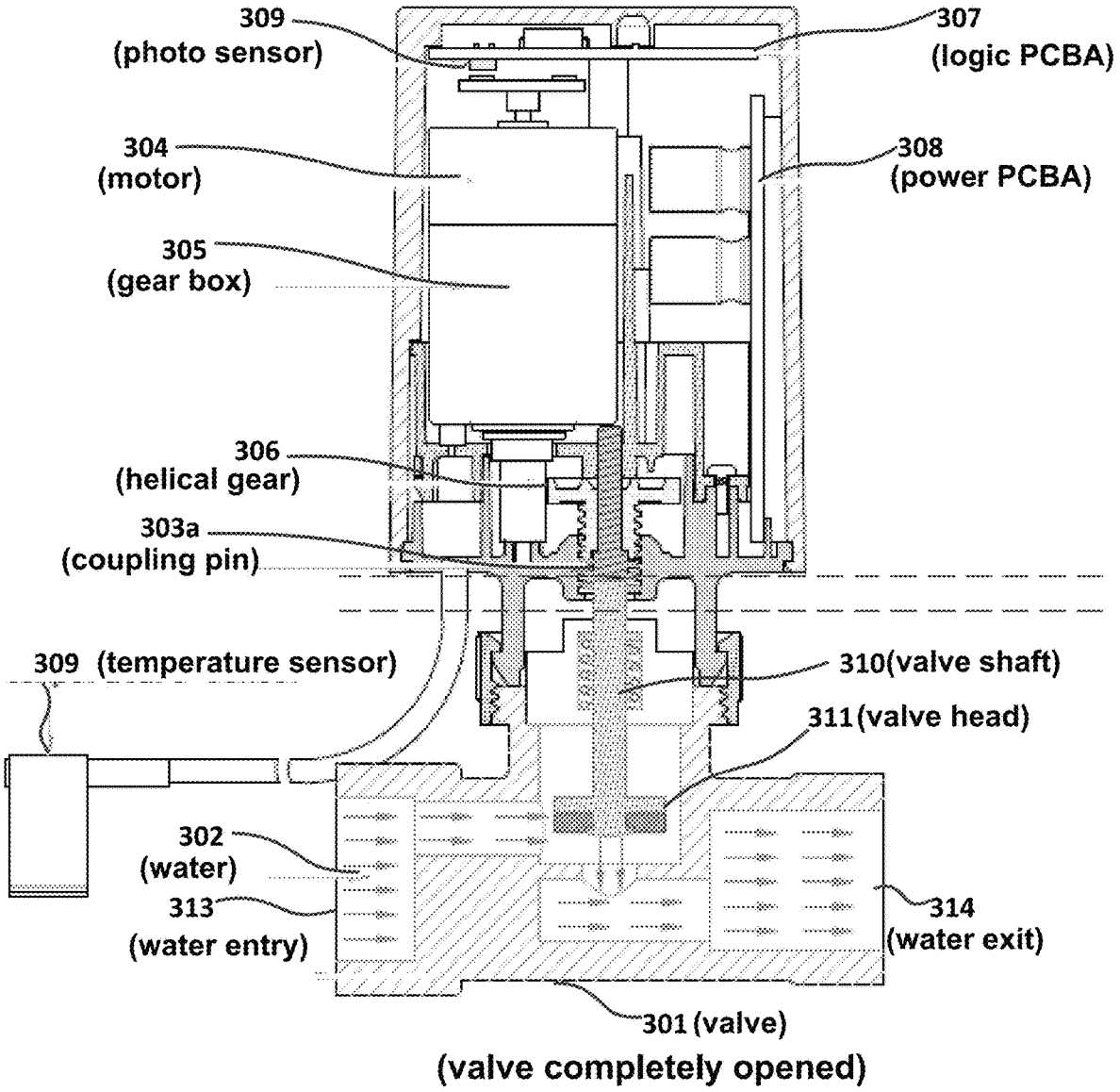
FIG. 3A shows a balance valve in a completely opened position in accordance with an embodiment.
Figure 3B:
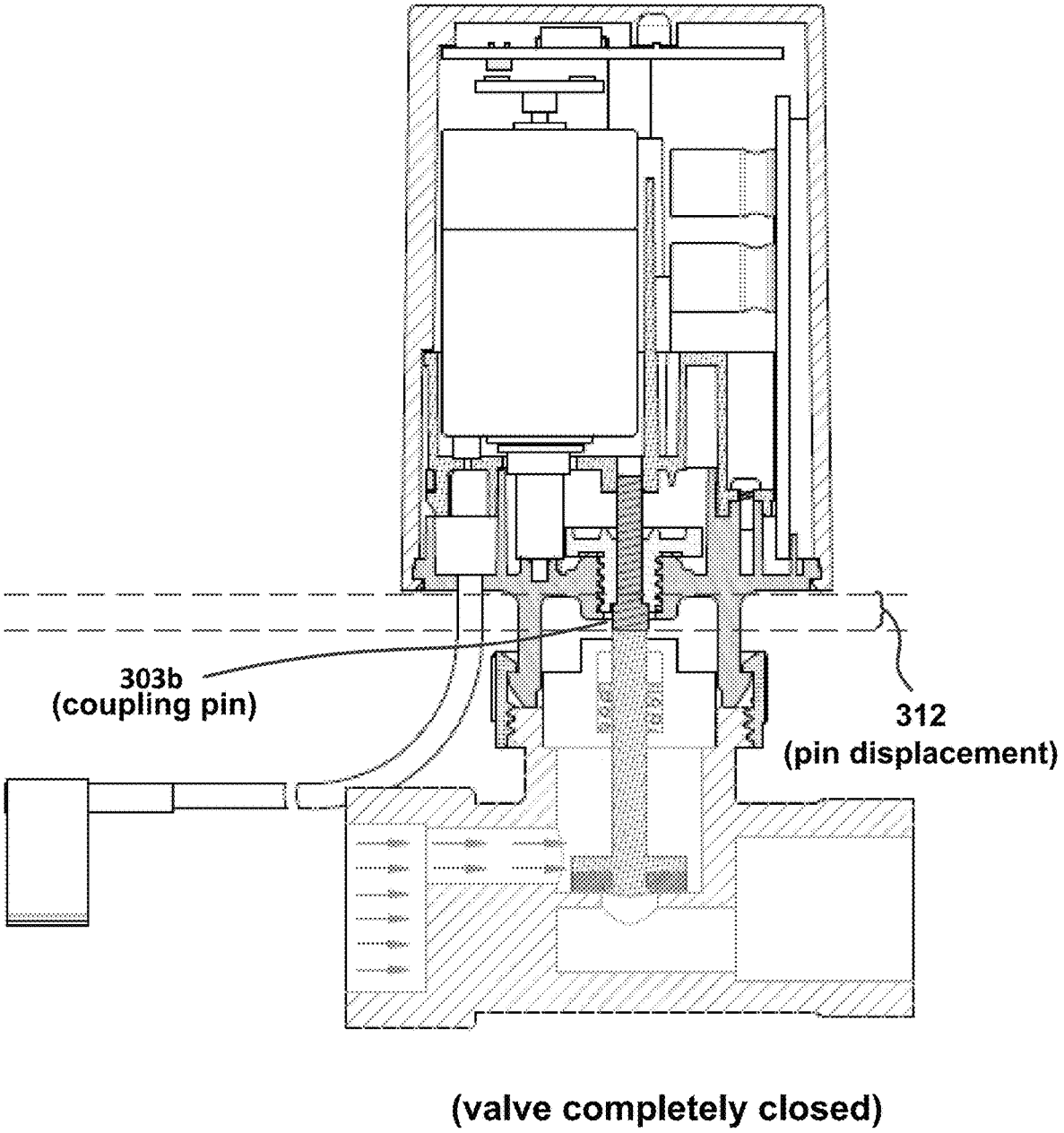
FIG. 3B shows a balance valve in a completely closed position in accordance with an embodiment.
Figure 5:
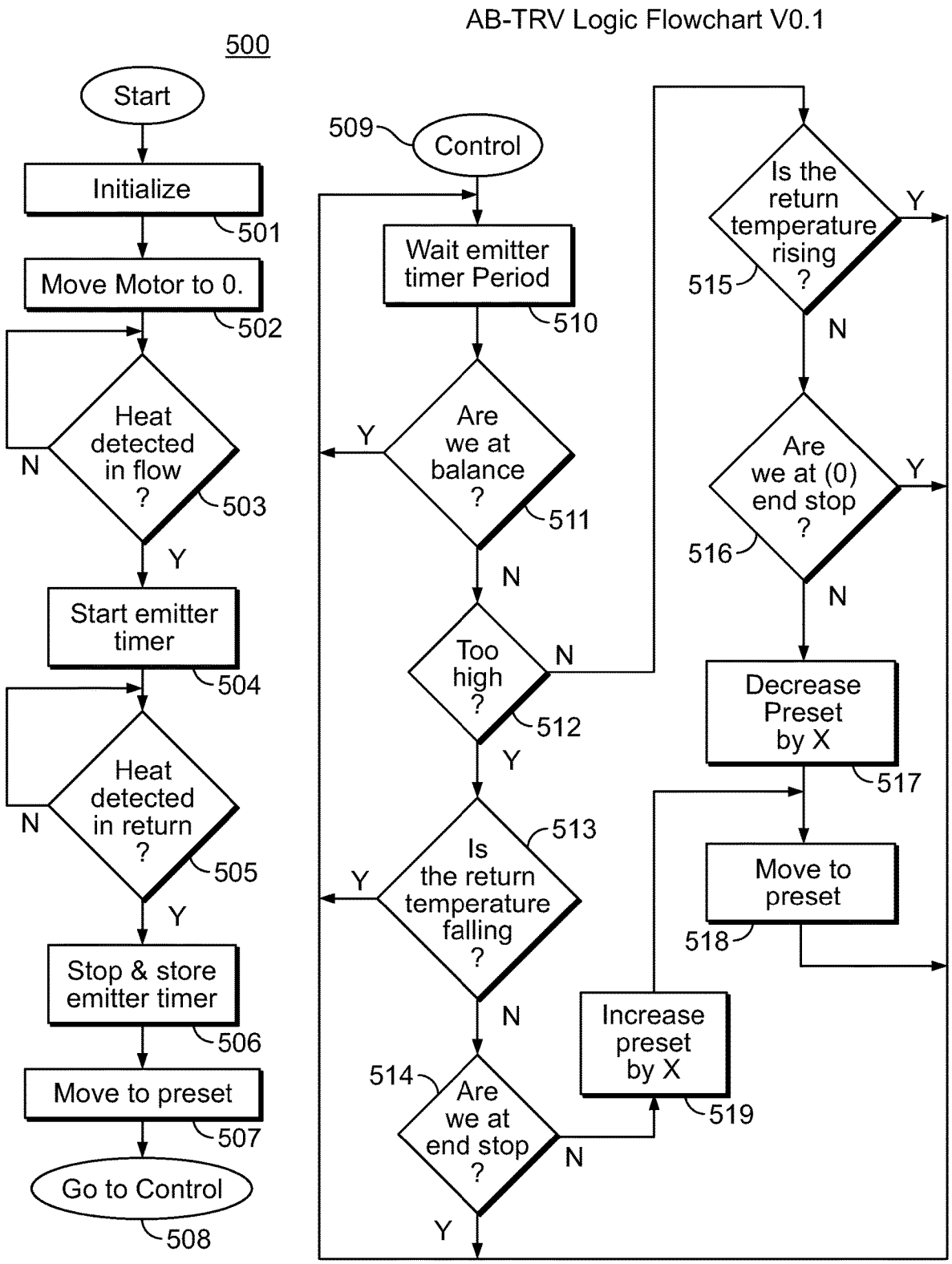
FIG. 5 shows a flowchart of the operation of an automatic balance valve controller in accordance with an embodiment.

FIGS. 3A and 3B show a balance valve assembly in a completely opened position and in a completely closed position, respectively. During operation, for example as shown in FIG. 5, the balance valve is typically somewhere between the completely closed and opened positions.

Referring to FIG. 3A, the balance valve comprises valve 301, a driving mechanism (motor 304 in combination with gear box 305), a coupling mechanism (helical gear 306), coupling pin 303*a* (corresponding to coupling pin 303*b* as positioned in FIG. 3B), valve shaft (stem) 310, logic printed circuit board assembly (PCBA) 307, and power PCBA 308. The balance valve obtains the measured temperatures at the inlet and outlet of an associated hydronic emitter (not explicitly shown) from temperature sensors such as temperature sensor 309.

Valve 301 is adjusted by positioning coupling pin 303*a* that abuts valve shaft 310. As a result, valve head 311 affects water flow 302 from water entry 313 to water exit 314, where the water flow through valve 301 is consequently the same as through the associated hydronic emitter. Valve 301 is fully opened in FIG. 3A but is fully closed in FIG. 3B because of pin displacement 312.

Logic PCBA 307 controls the operation of the balance valve by instructing motor 304 to rotate a desired amount (as detected via photo sensor 309). The motor movement is coupled to coupling pin 303*a,b* through gear box 305 and helical gear 306. As will be discussed in further detail logic PCBA 307 supports the functionalities of the balance valve controller.

Power PCBA 308 provides electrical power to logic PCBA 307. Logic PCBA 307 may be powered by a main AC or low voltage AC/DC power supply or fully powered by battery or rechargeable battery. When supplied by AC or DC power supply, the power supply may be disconnected by an external thermostat. When electrical power is disconnected from the balance valve, an internal energy storage circuitry may enable the balance valve controller to continue to sustain the motor action to close the balance valve. The internal energy storage circuitry may be a battery, rechargeable battery, high capacity capacitor, and/or any form of energy storage module.

Figure 4:
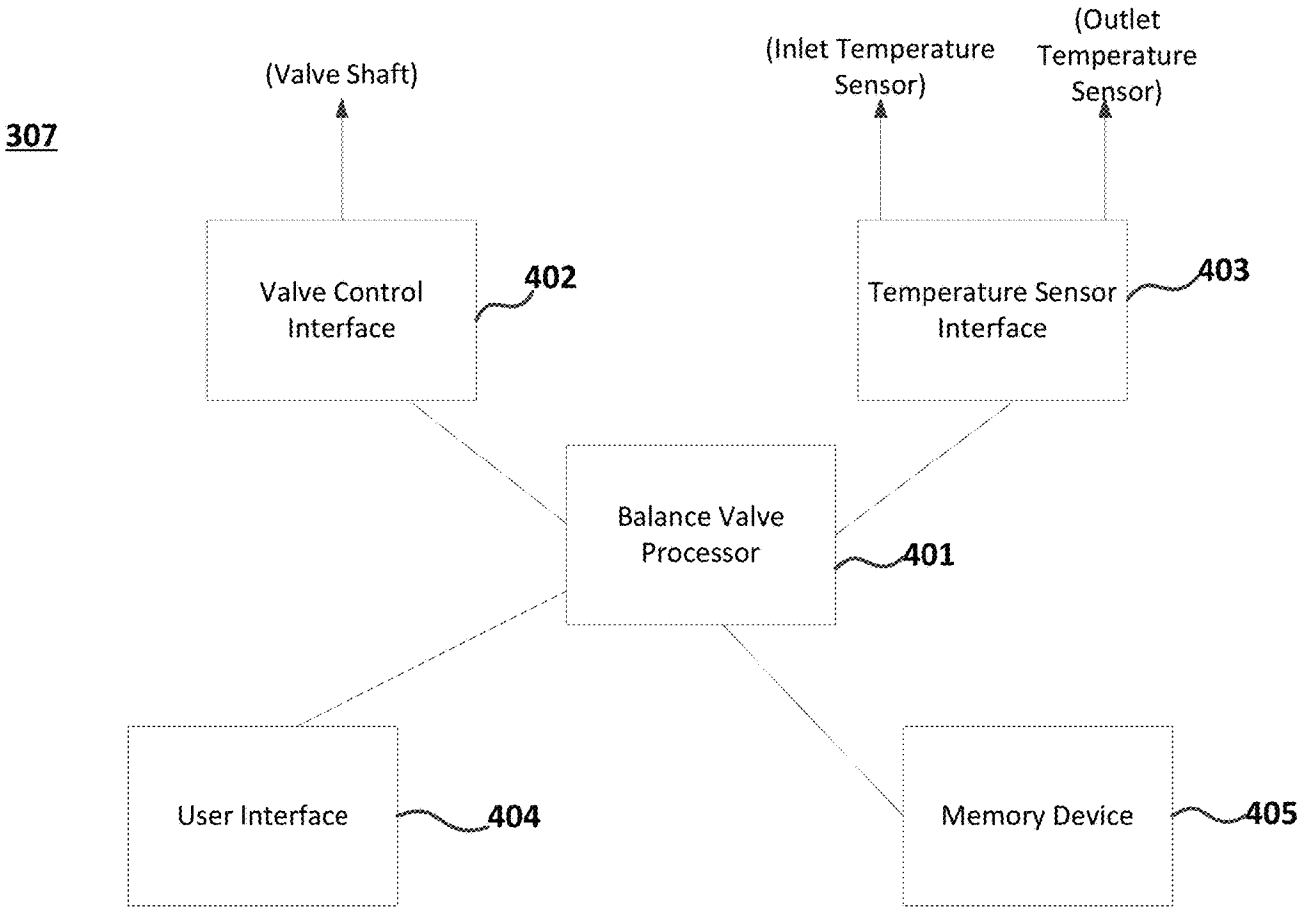
FIG. 4 shows an automatic self-adjusted balance valve controller in accordance with an embodiment.

FIG. 4 shows an automatic self-adjusted balance valve controller (e.g., logic printed circuit board assembly (PCBA) 307 as previously shown in FIG. 3A) in accordance with an embodiment. Automatic self-adjusted balance valve controller 307 comprises of a processor controller unit 401 with an interface 403 to two temperature sensors (e.g., sensors 104 and 105 as shown in FIG. 1) measuring the inlet and outlet temperature of the emitter and controlling valve shaft 310 by appropriating moving coupling pin 303*a,b* a determined distance via valve control interface 402. Referring to FIG. 3A, valve control interface comprises photo sensor 309 and wires (not explicitly shown) that activate motor 304. Valve controller 307 adjusts the movement of coupling pin 303*a,b* to achieve a constant (stable) temperature differential between the inlet and outlet of the emitter. The temperature differential may be a fixed value or may be adjusted by user.

The temperature differential setting between inlet and outlet may be a fixed value or a value that input by user through user interface 404 of the balance valve processor 401.

With reference to FIG. 4, the computing system environment may include a computing device wherein the processes (e.g., shown in FIG. 5) discussed herein may be implemented. The computing device may have a processor 401 for controlling overall operation of the computing device and its associated components, including RAM, ROM, communications module, and memory device 405. The computing device typically includes a variety of computer readable media. Computer readable media may be any available media that may be accessed by computing device and include both volatile and nonvolatile media, removable and non-removable media. By way of example, and not limitation, computer readable media may comprise a combination of computer storage media and communication media.

Computer storage media may include volatile and nonvolatile, removable and non-removable media implemented in any method or technology for storage of information such as computer readable instructions, data structures, program modules or other data. Computer storage media include, but is not limited to, random access memory (RAM), read only memory (ROM), electronically erasable programmable read only memory (EEPROM), flash memory or other memory technology, CD-ROM, digital versatile disks (DVD) or other optical disk storage, magnetic cassettes, magnetic tape, magnetic disk storage or other magnetic storage devices, or any other medium that can be used to store the desired information and that can be accessed by the computing device.

Communication media typically embodies computer readable instructions, data structures, program modules or other data in a modulated data signal such as a carrier wave or other transport mechanism and includes any information delivery media. Modulated data signal is a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media.

Referring to FIG. 4, the settings of the balance valve may be configured via user interface 404. For example, the temperature differential setting between inlet 102 and outlet 103 may also be setup through any form of radio frequency signal to balance valve processor 401 before or during the operation of balance valve processor 401 or by a wired communication.

A variable differential value may be input to the balance valve to allow a different balance value at different times or temperature control situations, for example, when the hydronic emitter is required to provide more heating/cooling or less heating/cooling. This can be input by the user or by time schedule or by radio frequency or wired communication and so forth.

FIG. 5 shows flowchart 500 of the operation of automatic balance valve processor 401 (as shown in FIG. 4) in the heating mode, where the processor 401 executes computer-executable instructions stored in memory device 405.

Processor 401 configures the balance valve at blocks 501-508. At block 501, controller initializes the balance valve.

At blocks 502-506, processor 401 determines the emitter timer duration based on the water flow characteristics of the supported hydronic emitter. The purpose of the emitter timer is to provide an incremental time for periodically updating the positioning of the coupling pin (corresponding to coupling pin 303*a,b* as shown in FIGS. 3A and 3B) by processor 401 when executing blocks 509-518 as will be discussed.

At block 502, the coupling pin is positioned at the zero position (no displacement) so that the balance valve is in the completely opened position (as shown in FIG. 3A). Once heat is detected in at inlet 103 (as measured by temperature sensor 106) at block 503, the emitter timer is started at block 504. The time for the water flow to travel from inlet 103 to outlet 104 of the hydronic emitter is determined by the flow characteristics of the hydronic emitter. The value of the emitter timer (emitter timer period) is stored when heat is detected at outlet 103 (as measured by temperature sensor 105) at blocks 505-506. The stored timer value is subsequently used at block 510.

At block 507, processor 401 instructs motor 304 to move the coupling pin to the preset position. Processor 401 enters the control mode at block 509 via block 508.

When in the control mode, processor 401 periodically updates the displacement of the coupling pin every emitter timer period at block 510.

At block 511, process 500 determines whether the balance valve is balance (i.e., whether the measured temperature differential equals the desired temperature differential). If so, the valve controller returns to block 510 and waits until the next emitter timer period. Otherwise, at block 512, processor 401 determines whether the measured return temperature (at outlet 103 as shown in FIG. 1) is too high. If so, valve processor 401 determines whether the measured return temperature is falling at block 513. If so, the measured return temperature is properly adjusting, and processor 401 returns to block 510. If the measured return temperature is not falling, controller 410 determines the displacement increase of the coupling pin at block 519 in order to reduce the water flow through the balance valve unless the full end stop (i.e., the coupling pin cannot be further extended) has been reached as detected at block 514.

If valve processor 401 determines that the measured return temperature (at outlet 103) is too low (i.e., not too high) at block 512, valve processor 401 determines whether the measured return temperature is rising at block 515. If so, the measured return temperature is properly adjusting, and processor 401 returns to block 510. If the measured return is not rising, processor 401 determines the displacement decrease of the coupling pin at block 517 in order to increase the water flow through the balance valve unless the zero end stop (i.e., the coupling pin cannot be further reduced) has been reached as detected at block 516.

At block 518, valve processor 401 instructs motor 304 to move the coupling pin the displacement change as determined at block 517 or 519.

As can be appreciated by one skilled in the art, a computer system with an associated computer-readable medium containing instructions for controlling the computer system can be utilized to implement the exemplary embodiments that are disclosed herein. The computer system may include at least one computer such as a microprocessor, digital signal processor, and associated peripheral electronic circuitry.

What is claimed is:

1. A balance valve assembly comprising:

a water entry;

a water exit;

a valve controlling water flow through a hydronic emitter, the valve comprising:

a valve shaft, wherein the water flow between the water entry and the water exit is adjusted by positioning the valve shaft;

a coupling pin abutting the valve shaft;

a driving mechanism;

a coupling mechanism coupling the driving mechanism to the coupling pin; and a valve controller:

determining a time period based on a measured flow characteristic of the hydronic emitter;

obtaining a measured temperature differential between an inlet and an outlet of the hydronic emitter;

determining a determined distance to move the coupling pin to obtain a desired water flow through the hydronic emitter based on the measured temperature differential;

instructing the driving mechanism to move the coupling pin, through the coupling mechanism, the determined distance; and waiting for said time period before continuously repeating the instructing.

2. The balance valve assembly of claim 1, wherein the valve controller adjusts the coupling pin to maintain an essentially constant temperature differential between the inlet and outlet of the hydronic emitter.

3. The balance valve assembly of claim 2 further comprising:

a user interface for receiving information about a desired temperature differential; and the valve controller maintaining the essentially constant temperature differential at the desired temperature differential.

4. The balance valve assembly of claim 3, wherein:

the valve controller receives, through the user interface, a plurality of desired temperature differential values based on different times of operation.

5. The balance valve assembly of claim 3, wherein:

the valve controller receives, through the user interface, a plurality of desired temperature differential values based on different temperature control situations.

6. The balance valve assembly of claim 2 further comprising:

the valve controller obtaining a fixed desired temperature differential value and maintaining the essentially constant temperature differential at the fixed temperature differential value.

7. The balance valve assembly of claim 1, wherein the coupling mechanism comprises a helical gear that moves the coupling pin.

8. The balance valve assembly of claim 1, wherein the driving mechanism comprises an electric motor.

9. The balance valve assembly of claim 1, wherein the valve controller periodically updates the determined distance of the coupling pin every said time period.

10. The balance valve assembly of claim 1, wherein the balance valve assembly is located at the inlet of the hydronic emitter.

11. The balance valve assembly of claim 1, wherein the balance valve assembly is located at the outlet of the hydronic emitter.

12. A method for controlling water flow through a hydronic emitter, the method comprising:

determining a time period based on a measured flow characteristic of the hydronic emitter;

obtaining a measured temperature differential between an inlet and an outlet of the hydronic emitter;

determining a determined distance to move a coupling pin to obtain a desired water flow through the hydronic emitter based on the measured temperature differential, wherein the coupling pin abuts a valve shaft;

instructing a driving mechanism through a coupling mechanism to move the coupling pin the determined distance; and waiting for said time period before continuously repeating the instructing.

13. The method of claim 12 further comprising:

adjusting the coupling pin to maintain an essentially constant temperature differential between the inlet and outlet of the hydronic emitter.

14. The method of claim 13 further comprising:

receiving data about a desired temperature differential; and maintaining the essentially constant temperature differential at the desired temperature differential.

15. The method of claim 14 further comprising:

receiving a plurality of desired temperature differential values based on different times of operation.

16. The method of claim 14 further comprising:

receiving a plurality of desired temperature differential values based on different temperature control situations.

17. The method of claim 12, wherein a measured inlet temperature is greater than a measured outlet temperature of the hydronic emitter.

18. The method of claim 12, wherein a measured outlet temperature is greater than a measured inlet temperature of the hydronic emitter.

19. A non-transitory computer-readable medium storing computer-executable instructions that, when executed by a processor, cause an apparatus to perform:

obtaining a measured temperature differential between an inlet and an outlet of a hydronic emitter;

determining a determined distance to move a coupling pin to obtain a desired water flow through the hydronic emitter based on the measured temperature differential wherein the coupling pin abuts a valve shaft;

instructing a driving mechanism through a coupling mechanism to move the coupling pin the determined distance;

determining a time period based on a flow characteristic of the hydronic emitter; and waiting for the time period before continuously repeating the instructing.

* * * * *